US005618546A

United States Patent [19]

Wood et al.

[11] Patent Number: 5,618,546

[45] Date of Patent: Apr. 8, 1997

[54] COMPOSITE OF SELECTIVELY REMOVABLE LAYERS OF SILK SCREEN PRINTING INK

[76] Inventors: Monte D. Wood, 17765 Vista Ave., Monte Sereno, Calif. 95030; Asutosh Nigam, 20 Willow Rd., Apt. #9; Orton D. Bergren, 194 Santa Margarita, both of Menlo Park, Calif. 94025

[21] Appl. No.: 228,045

[22] Filed: Apr. 15, 1994

[51] Int. Cl.[6] ..... A01N 25/34; B32B 27/14; B27N 9/00

[52] U.S. Cl. ..... 424/402; 428/196; 428/199; 428/920; 442/71; 442/123

[58] Field of Search ..... 428/284, 286, 428/920, 196, 199; 427/259, 264, 272, 282, 288, 391, 395, 411, 416; 156/83; 424/402

[56] References Cited

U.S. PATENT DOCUMENTS

| | | | |
|---|---|---|---|
| 4,175,151 | 11/1979 | Eppich et al. | 428/202 |
| 4,351,871 | 9/1982 | Lewis et al. | 428/195 |
| 4,399,177 | 8/1983 | Ozasa | 428/199 |
| 4,438,169 | 3/1984 | Daniels et al. | 428/196 |
| 4,507,350 | 3/1985 | Hendrix et al. | 428/196 |
| 4,725,849 | 2/1988 | Koike et al. | 346/75 |
| 4,838,965 | 6/1989 | Bussard | 156/83 |
| 5,229,201 | 7/1993 | Blanco | 428/284 |

*Primary Examiner*—Thurman K. Page
*Assistant Examiner*—Kathryne E. Shelborne
*Attorney, Agent, or Firm*—Albert M. Herzig, Esq.

[57] ABSTRACT

A composite of selectively removable layers of silk screen printing ink above a base layer serving as a substrate or receptor surface. The silk screen printing inks have compositions allowing them to be permanent, selectively removed with water and selectively removed with water and detergent as a washing compound. The composite is used for selectively altering the graphic or artistic presentation of a sales or promotional item so as to reveal a hidden message underneath or simply to alter or eliminate all or portions of the presentation.

10 Claims, 2 Drawing Sheets

COMPOSITE OF SELECTIVELY REMOVABLE LAYERS OF SILK SCREEN PRINTING INK

BACKGROUND OF THE INVENTION

1. Field of the Invention

The present invention generally relates to transfer printing and more particularly to a composite consisting of a base receptor surface and one or more opaque layers of silk screen printing ink having different compositions allowing selective removal by choice of washing compounds.

2. Description of the Prior Art

In the various arts, transfer materials are used to make marks at desired locations on receptor surfaces. Two common modes of material transfer to receptor surfaces are the application of physical pressure and the evaporation of a carrier liquid. Printing methods transferring inks and dyes generally consist of roller printing, screen printing, transfer printing and ink-jet printing systems. The low viscosities required for dyes and inks transferred by spray type printing such as silk screen printing and ink-jet printing, make them more susceptible to absorption in the receptor surface, particularly in woven cloth or fabric and other hydrophilic compounds. Inks and dyes transferred by this process are presently not removable after drying by washing with water or with water and ordinary household laundry detergent. In fact, the object of most silk screen printing is to achieve a permanent or colorfast transfer of the ink that remains on the receptor surface to avoid disappearance, fading or destruction of the original print. An example of the desired goal of permanent dyeing of the receptor surface is described in U.S. Pat. No. 4,725,849. Another example of the desire for colorfast permanence is found in U.S. Pat. No. 4,177,076 where the "water or alcohol soluble printing ink composition" described there discusses the disadvantages of unsatisfactory water-proof properties.

These conventional and existing methods of transfer and inks do not satisfy the need to remove all or a desired portion of a dried ink applied to a receptor surface so as to alter the graphic or artistic presentation on the product. There is a need for a composite allowing removal of some or all of an opaque ink in sales, advertising and promotion so as to reveal a different or hidden presentation underneath.

Prior art such as U.S. Pat. No. 4,846,504 describes a label assembly including concealed promotional material that is secured to the product package with an assembly including water-soluble adhesive. That art is not suitable for silk screen printing and cannot be applied in a manner allowing the definition required for artistic or graphic presentation itself but merely acts as an adhesive. U.S. Pat. No. 3,993,492 discloses a water-soluble transfer coating material but is composed of a non-resinated dry pigment suitable for application only by pressure transfer and not suitable for the definitive application required for artistic or graphic rendering.

However, none of the relevant art discloses a composite consisting of opaque layers of dry ink of silk screen printing viscosity with properties allowing selective removal by application of water or water and ordinary household laundry detergent so as to change the original composite presentation and not affect the color of the remaining composite or other material in the washing unit.

SUMMARY OF THE INVENTION

Accordingly, the above problems and difficulties are obviated and an unfilled need is satisfied by the present invention which provides a novel layered composite of one or more silk screen printing inks which may be removed by choice of washing compound so as to reveal a different or hidden presentation underneath. This invention consists of a receptor surface or base substrate layer serving as a foundation for a composite including one or more opaque layers of silk screen printing ink of varying compositions allowing selective removal by choice of washing solution. The base or receptor surface can be of any composition that accepts silk screen printing ink in a manner that allows enough definition for artistic rendering. The silk screen printing inks of varying removable qualities may be applied in the sequences and combinations of composites or partial composites described herein depending on the desired result. One ink may have qualities that allow permanent and colorfast acceptance onto the receptor surface by the spray application of silk screen printing. Another ink may have qualities that allow it to be sprayed on top of the receptor surface, permanent ink layer or detergent washable ink layer in an opaque presentation that remains until selective removal by choice of water alone as a washing compound. Still another ink may have qualities that allow it to be sprayed on top of the receptor surface or permanent ink layer in an opaque presentation that remains until selective removal by choice of a washing compound consisting of water plus ordinary household laundry detergent.

The primary object of the invention is to present a graphic or artistic presentation that can be changed so as to conceal one or more messages or symbols underneath an existing presentation.

Another object of the invention is to provide a novel means of changing a displayed work of art on fabrics by removing all or part of an opaque silk screen printing ink layer from the existing presentation.

Still another object of the invention provides a novel means of achieving sales, advertising and promotional goals whereby a company could promote their product by a contest involving either the purchase or giving away of T-shirts, and if the recipient washes the shirt with water, it will then reveal a hidden message or symbol underneath the removed opaque layer of dried silk screen printing ink to indicate whether or not they win a prize.

An additional objective of the invention is to provide manufactures of appropriate receptor products, such as garments, the ability to print sizing and identification directly on the garment replacing a more costly and cumbersome sewn in label. Such an imprint on a garment would disappear completely after the first washing while leaving the essence of the garment unmarked. This function would also prove as a security feature to ensure that a garment has not been washed, if a patron should seek to return the item for refund or credit.

Finally, another objective of the invention is to provide a visible marking element for any receptor surface that needs to be washed prior to use or any receptor surface that should not be exposed to water or washing. Any exposure to water would eliminate this specialized ink and visibly demonstrate the exposure.

BRIEF DESCRIPTION OF THE DRAWINGS

The features of the present invention, which are believed to be novel, are set forth with particularity in the appended claims. The present invention, both as to its organization and manner of operation, together with further objects and advantages thereof, may best be understood with reference to the following description, taken in connection with the accompanying drawings in which:

DETAILED DESCRIPTION OF THE INVENTION

Figure 1:
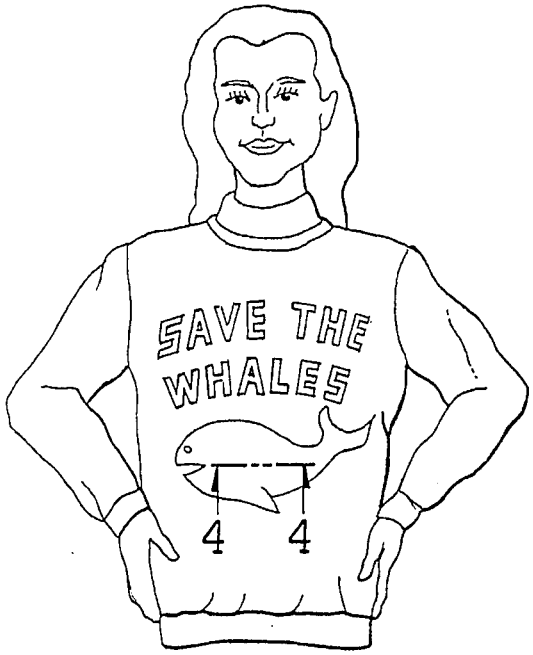
FIG. 1 is a diagrammatic view showing the concept of the invention embodied on a sweat shirt base with three layers of silk screen printing ink in the sequence of base, permanent, detergent washable then water washable, displaying a particular graphic and artistic presentation.

Referring now to the drawings, and more particularly, to FIG. 1, there is shown a composite of selectively removable layers of silk screen printing ink which incorporates the preferred embodiment of the present invention in the sequence of base 20, permanent layer 21, detergent washable layer 22 then water washable layer 23. The composite includes a base layer 20 having a receptor surface with a composition suitable for carrying a printing ink such as a cotton sweat shirt; a layer of permanent printing ink 21 (permanent layer) immediately above or on top of selected portions of the base layer 20; a layer of detergent washable printing ink 22 (detergent washable layer) immediately above selected portions of the permanent layer 21; and a layer of water washable ink 23 (water washable layer) immediately above selected portions of the detergent washable layer 22.

Figure 2:
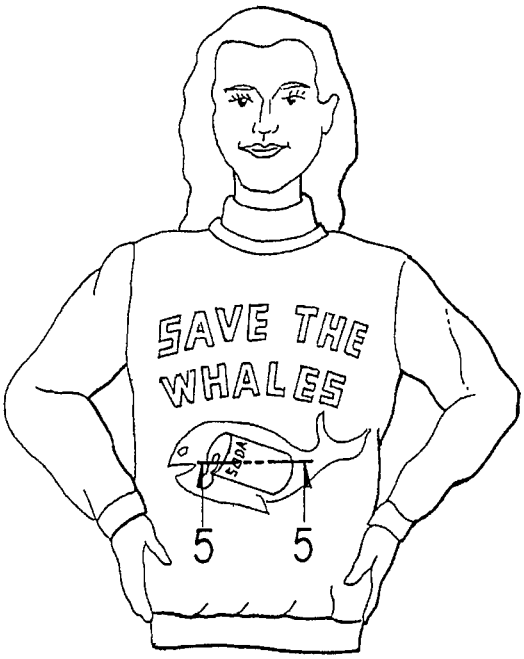
FIG. 2 is a diagrammatic view of the same composite displayed in FIG. 1 with the water washable layer removed after washing the sweat shirt in water.
Figure 5:
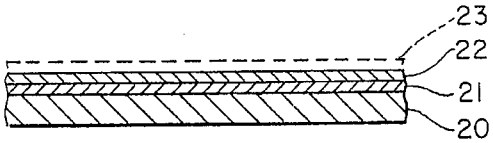
FIG. 5 is a cross-sectional view of the composite of FIG. 2 taken along lines 5—5 showing the base 20, permanent and detergent washable 22 layers with the water washable 23 layer removed.

FIG. 2 illustrates the composite of FIG. 1 after selective removal of the water washable layer 23 by application of water and the resulting layers are shown in a cross-section view in FIG. 5 with the water washable layer 23 removed.

Figure 3:
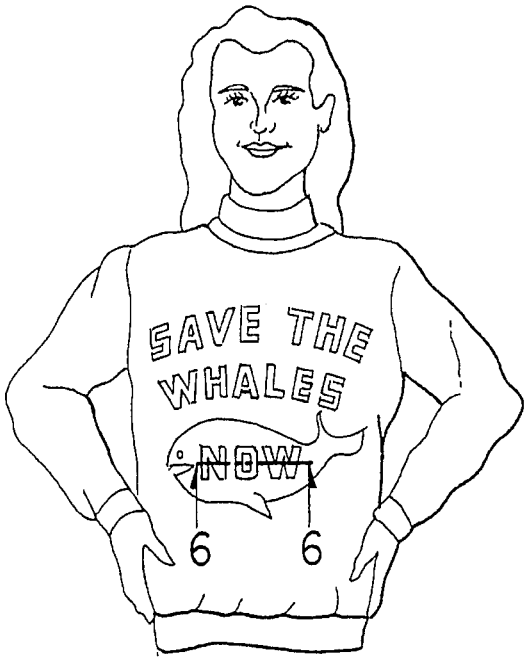
FIG. 3 is a diagrammatic view of the same composite as FIG. 2 with the detergent washable layer removed after washing the sweat shirt in water and laundry detergent.

FIG. 3 illustrates the composite of FIG. 2 after selective removal of the detergent washable layer 22 by application of water and detergent. The remaining layers of base 20 and permanent layer 21 are shown in a cross-section view in FIG. 6 with the water washable 23 and detergent washable 22 layers removed.

Figure 4:
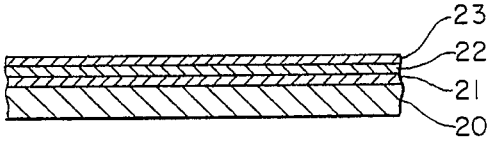
FIG. 4 is a cross-sectional view of the composite of FIG. 1 taken along lines 4—4 showing the base 20 and three ink layers.
Figure 6:
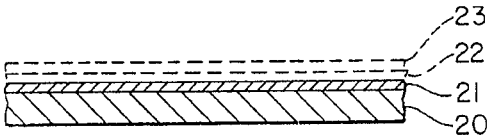
FIG. 6 is a cross-sectional view of the composite of FIG. 3 taken along lines 6—6 showing the base 20 and permanent 21 layer with the water washable 23 and detergent washable 22 layers removed.

In the preferred embodiment of the composite as shown in FIG. 1 three layers of silk screen printing ink 21, 22 and 23 are layered above the base layer 20 in that sequence. FIG. 4 is a cross-sectional view of the composite of FIG. 1 taken along lines 4—4. This base layer 20 acts as a receptor surface for the spray application of printing ink. The base layer 20 may be of any material that is suitable for accepting printing inks such as silk screen printing ink. Suitability for this purpose means any material with a composition or structure that can accept an ink of spray or silk screen printing viscosity in a manner allowing enough definition to accurately display the artistic or graphic presentation intended. The best embodiment for the base layer 20 would be a tightly woven fabric consisting of hydrophilic fibers. These hydrophilic fibers absorb and hold liquid ink at the time of application by the means of silk screen printing. It is also contemplated that all garments and fabrics, either natural or artificial, would be suitable for this purpose, in addition to substrates such as paper, cardboard, water wettable plastics and many other organic and inorganic receptor surfaces used in advertising, promotion and marketing in general. FIG. 5 illustrates a cross-section of FIG. 2 taken along lines 5—5 wherein the water-washable ink layer 23 shown in FIG. 4 has been removed. FIG. 6 illustrates a cross-section of FIG. 3 taken along lines 6—6 wherein the detergent washable layer 22 shown in FIG. 5 has been removed.

In the preferred embodiment the layer immediately above the base layer 20 in FIG. 6 is colorfast or permanent once applied and has a different composition from both the water washable 23 and detergent washable ink 22 layers. This permanent ink layer 21 may be any printing ink of silk screen printing viscosity that has qualities rendering it permanent or colorfast after application so that when cured it is not water or water and detergent soluble such as plastisols and solvent or water based permanent inks that are commercially available from manufacturers including but not limited to Custom Colors, Inc., Champion Ink and J&S Ink Company.

The detergent washable layer 22 immediately above the permanent layer 21 is an ink that has qualities rendering it opaque, removable upon application of water with ordinary household laundry detergent and the additional quality of not affecting the color or appearance of the remaining portions of the composite or any other material in the washing unit once removed. This detergent washable layer 22 contains a binder, a pigment, a buffer, a fungicide and an opacifier. The composition of the elements of the detergent washable layer are as follows:

Binder: a material selected from the group consisting of polymers completely soluble in laundry detergent solution or at a basic pH such as Carboset 514H.

Pigment: a material selected from the group consisting of colorants stable at basic pH that do not leach out in plain water such as Victoria Blue.

Buffer: a material selected from the group consisting of inorganic bases such as sodium carbonate, sodium bicarbonate, sodium hydroxide, potassium carbonate, potassium hydroxide and potassium bicarbonate.

Fungicide: a material selected from the group consisting of fungus killing material such as sodium omadine (Olin), Fungitrol (Huls America), Microcheck (Ferro Corp.), Vancide (R. T. Vanderbilt Co.) and sodium benzoate.

Opacifier: a material selected from the group consisting of white inorganic pigments such as titanium dioxide, zinc oxide and talc.

The water washable layer 23 immediately above the detergent washable layer 22 is an ink that has qualities similar to those of the detergent washable ink with the exception that it is removable upon application of water alone. This water washable ink layer 23 is composed of the same elements as the water and detergent washable layer 22 except the binder and pigment elements are of a different composition as follows:

Binder: a material selected from the group consisting of readily water soluble polymers such as polyvinyl alcohol.

Pigment: a material selected from the group consisting of colorants easily removable by plain water washing without affecting other materials in the washing machine such as azophiloxane.

The layers of the composite immediately above the base layer 20 may be applied in any sequence or combination of layers as set forth herein in order to achieve the particular desired result in the form of a partial composite consisting of a base layer 20 and one or more permanent 21, detergent washable 22 or water washable 23 layers. Each layer above the base layer consists of an ink of silk screen printing viscosity and each ink is applied separately by means of the silk screen printing process when in its liquid state. Each layer above the base layer 20 after application is allowed to dry prior to applying the next layer of silk screen printing ink which is again allowed to dry prior to applying the next layer of silk screen printing ink. The extent of coverage and placement of one layer over all or portions of the underlying layer will allow for any intended artistic or graphic design to be displayed at any particular desired layer level. In the preferred embodiment the layers are approximately 1 millimeter in thickness but can be applied in any thickness that results in opacity.

Figure 7:
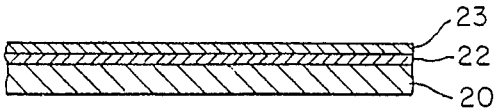
FIG. 7 is a cross-sectional view of a partial composite in the sequence of base 20, detergent washable 22 ink layer, then water washable 23 ink layer.
Figure 8:
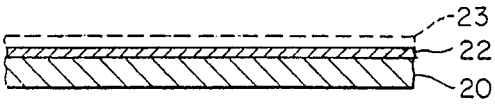
FIG. 8 is a cross-sectional view of the partial composite of FIG. 7 showing the water washable 23 ink layer removed by washing in water.
Figure 9:
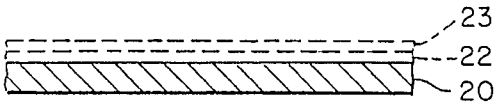
FIG. 9 is a cross-sectional view of the partial composite of FIG. 8 showing the detergent washable 22 ink layer removed after washing in water with laundry detergent.
Figure 10:
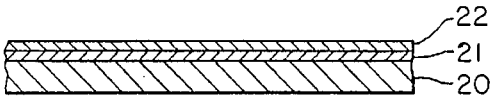
FIG. 10 is a cross-sectional view of a partial composite in the sequence of base 20, permanent ink 21 layer and then a detergent washable 22 ink layer.
Figure 11:
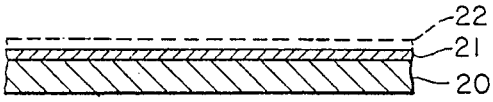
FIG. 11 is a cross-sectional view of the partial composite of FIG. 10 with the outermost detergent washable 22 ink layer removed after washing in water with detergent.
Figure 12:
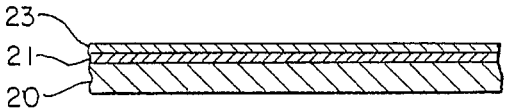
FIG. 12 is a cross-sectional view of a partial composite in the sequence of base 20, permanent ink 21 layer and then a water washable 23 ink layer.
Figure 13:
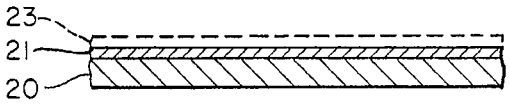
FIG. 13 is a cross-sectional view of the partial composite of FIG. 12 with the outermost water washable 23 ink layer removed after washing in water.
Figure 14:
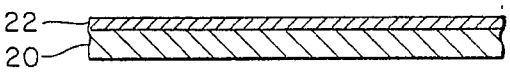
FIG. 14 is a cross-sectional view of a partial composite of base 20, then detergent washable 22 ink layer.
Figure 15:
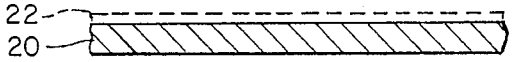
FIG. 15 is a cross-sectional view of the partial composite of FIG. 14 showing the detergent washable 22 ink layer removed after washing in water with detergent.
Figure 16:
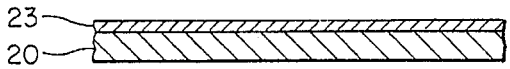
FIG. 16 is a cross-sectional view of a partial composite of base 20, then water washable 23 ink layer.
Figure 17:
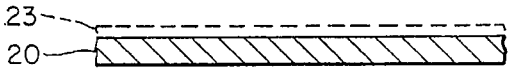
FIG. 17 is a cross-sectional view of the partial composite of FIG. 16 showing the water washable 23 ink layer removed after washing in water.

Examples of other combinations and sequences forming a partial composite of layers using the base 20, permanent ink layer 21, water washable 23 ink layer and detergent washable 22 ink layer are:

1. Base 20, then permanent layer 21, then detergent washable layer 22; illustrated by FIG. 10. FIG. 11 is a cross-sectional view of the partial composite of FIG. 10 with the detergent washable 22 ink layer removed after washing with detergent.
2. Base 20, then permanent layer 21, then water washable layer 23; illustrated by FIG. 12. FIG. 13 is a cross-sectional view of the partial composite of FIG. 12 with the water washable 23 layer removed.
3. Base 20, then detergent washable layer 22, then water washable layer 23; illustrated by FIG. 7. FIG. 8 is a cross-sectional view of the partial composite of FIG. 7 showing the water washable 23 ink layer removed by washing in water. FIG. 9 is a cross-sectional view of the partial composite of FIG. 8 showing the detergent washable 22 ink layer removed after washing in water with laundry detergent.
4. Base 20, then detergent washable 22 layer; illustrated by FIG. 14. FIG. 15 is a cross-sectional view of the partial composite of FIG. 14 with the detergent washable 22 layer removed.
5. Base 20, then water washable layer 23; illustrated by FIG. 16. FIG. 17 is a cross-sectional view of the partial composite of FIG. 16 showing the water washable 23 ink layer removed after washing in water.

Accordingly, the invention provides the general means of changing the original graphic or artistic presentation one or more times depending on the choice of sequence and combination of layers and the selection and sequence of washing compounds. The innovative technology satisfies an unfilled need for many charitable and commercial entities that conduct sales, advertising and promotional activities by giving away or selling products such as garments that have a hidden message or prize-winning symbol that is revealed after being washed by the customer. Additionally, a label on a garment may be removed after purchase. In view of the foregoing, a variety of graphic or artistic presentations may be displayed and selectively removed so as to reveal altered messages or presentations.

Having thus described the composite of selectively removable layers of silk screen printing ink, it is obvious to those skilled in the art and contemplated herein that a variety of pigments as a component of the inks disclosed may be used to form the composites. It is contemplated further that these pigment variation inks would have similar qualities to the pigments described herein so as to render the same results in a functioning composite. More particularly, these pigments are chemically stable in basic pH environments.

It is thought that the composite of selectively removable layers of silk screen printing ink and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the form herein before described being merely a preferred or exemplary embodiment thereof.

What is claimed is:

1. A composite comprising:

a fibrous base layer carrying a first permanent layer of printing ink impregnated into fibers of said fibrous base layer;

a second layer of pigmented printing ink absorbed into said fibrous base layer and characterized as being totally removable by washing with a detergent; and said second ink layer including a binder selected from a group of polymers completely soluble at a basic pH.

2. A composite of selectively removable layers of opaque silk screen printing ink comprising:

a fibrous garment;

a first permanent printing ink layer impregnated into fibers of said garment and being stable at a basic pH unaffected by plain water;

at least one second layer of pigmented printing ink on said first permanent printing ink layer and being totally removable by washing with a detergent and further being stable at a basic pH and unaffected by plain water; and said second pigmented printing ink layer including a binder selected from a group of polymers completely soluble at a basic pH.

3. The invention as defined in claim 2 wherein:

said second pigmented printing ink layer further includes:

a buffer material selected from a group consisting of inorganic bases;

a fungicide material; and an opacifier material selected from a group consisting of white inorganic pigments.

4. The composite of claim 1 wherein said fibrous base layer is a white wettable plastic.

5. The composite of claim 1 wherein said base layer is a garment.

6. The composite of claim 1 wherein said base layer is a T-shirt.

7. The composite of claim 1 wherein said removable printing ink is a silk screen printing ink.

8. The composite of claim 1 wherein said removable printing ink is opaque.

9. The composite of claim 1 wherein said removable printing ink does not, once removed, affect or otherwise discolor said base layer or other material in the washing unit.

10. The composite of claim 1 wherein said removable printing ink contains a buffer, a fungicide, an opacifier, a pigment and a binder.

* * * * *